US011309660B1

(12) United States Patent
Campbell et al.

(10) Patent No.: US 11,309,660 B1
(45) Date of Patent: Apr. 19, 2022

(54) ANTI-VIBRATION STABILIZED CONNECTED SYSTEM WITH SELF-REJECTING ERGONOMIC FEEDBACK MECHANISM

(71) Applicant: Aptiv Technologies Limited, St. Michael (BB)

(72) Inventors: Jeffrey S. Campbell, West Bloomfield, MI (US); Wesley W. Weber, Jr., Metamora, MI (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 17/075,988

(22) Filed: Oct. 21, 2020

(51) Int. Cl.
*H01R 13/533* (2006.01)
*H01R 13/627* (2006.01)
*H01R 13/506* (2006.01)

(52) U.S. Cl.
CPC ..... *H01R 13/533* (2013.01); *H01R 13/506* (2013.01); *H01R 13/6272* (2013.01)

(58) Field of Classification Search
CPC ..... H01R 13/533; H01R 13/506; H01R 13/6272; H01R 13/639
See application file for complete search history.

(56) References Cited

U.S. PATENT DOCUMENTS 5,720,623 A * 2/1998 Polenick ..... H01R 13/641 439/352
6,514,099 B2 * 2/2003 Endo ..... H01R 13/641 439/357
6,579,118 B2 * 6/2003 Endo ..... H01R 13/6272 439/352
6,716,052 B2 * 4/2004 Kane ..... H01R 13/641 439/352
2002/0160651 A1 * 10/2002 Endo ..... H01R 13/641 439/489
2003/0045161 A1 * 3/2003 Endo ..... H01R 13/641 439/489

* cited by examiner

*Primary Examiner* — Tho D Ta
(74) *Attorney, Agent, or Firm* — Billion & Armitage

(57) ABSTRACT

A connector assembly includes a connector body, a corresponding mating connector body, and a connection position assurance (CPA) device. The connector body includes a deflectable latching member and at least one outer detent feature located on an outer surface of the connector body. The corresponding mating connector body is configured to be removably connected with the connector body, wherein the deflectable latching member is configured to secure the connector body to the corresponding mating connector body. The CPA device is slidably positioned adjacent the connector body and moveable from a pre-stage position to a full-stage position, wherein the CPA device interacts with the at least one outer detent feature located on the outer surface of the connector body to deflect the connector body towards the corresponding mating connector body.

17 Claims, 5 Drawing Sheets

ANTI-VIBRATION STABILIZED CONNECTED SYSTEM WITH SELF-REJECTING ERGONOMIC FEEDBACK MECHANISM

BACKGROUND

The present invention relates generally to electrical connectors and in particular to a connector position assurance feature that limits vibration.

Electrical connectors are used prominently in automotive applications. Typically, a connector body includes a latch or retention assembly utilized to maintain connector halves (i.e., male connector and a female connector) in a fully mated position. In some applications, connector position assurance (CPA) features are utilized to ensure that the connectors are fully mated. In general, a CPA is a feature that can be moved to a closed position only when the connector halves are fully mated with one another. In this way, a closed CPA provides visual assurance that the connector halves are fully mated.

SUMMARY

According to one aspect, a connector assembly is provided that includes a connector body, a corresponding mating connector body, and a connection position assurance (CPA) device. The connector body includes a deflectable latching member and at least one outer detent feature located on an outer surface of the connector body. The corresponding mating connector body is configured to be removably connected with the connector body, wherein the deflectable latching member is configured to secure the connector body to the corresponding mating connector body. The connection position assurance (CPA) device is slidably positioned adjacent the connector body and moveable from a pre-stage position to a full-stage position, wherein the CPA device interacts with the at least one outer detent feature located on the outer surface of the connector body to deflect the connector body towards the corresponding mating connector body.

According to another aspect, a method of operating a connector assembly includes mating a connector body with a corresponding mating connector body, wherein the connector body includes a deflectable latching member configured to interact with a latching nib located on the corresponding mating connector body. A connector position assurance (CPA) device is moved from a pre-stage position that allows the latching member to deflect to a full-stage position that prevents the latching member from deflecting, wherein the CPA device interacts with an outer detent feature located on the outer surface of the connector body to deflect the connector body towards the corresponding mating connector body in the full-stage position.

According to another aspect, a connector assembly includes a connector body, a corresponding mating connector body, and a connection position assurance (CPA) device. The connector body includes a deflectable latching member and at least one outer detent feature located on an outer surface of the connector body. The corresponding mating connector body is configured to be removably connected with the connector body, wherein the deflectable latching member is configured to secure the connector body to the corresponding mating connector body. The connection position assurance (CPA) device includes a spring over stress protection feature and a hoop spring surrounding the spring over stress protection feature, wherein the hoop spring is deflected by the latching member as the CPA device is moved from a pre-stage position to a full-stage position. The hoop spring snaps over the deflectable latching member when in the full-stage position and the spring over stress protection feature interacts with the deflectable latching member to prevent deflecting of the latching member.

DETAILED DESCRIPTION

The present invention is directedly generally to a connector assembly that includes connector body, a corresponding mating connector body, and a connector position assurance (CPA) device. The connector body is mated with the corresponding mating connector body. The CPA device is utilized to ensure that the connector bodies are fully engaged with one another by sliding the CPA device from a first pre-stage position to a second, full-stage position. In particular, the CPA device provides tactile feedback to an operator indicating whether the CPA device has been fully closed or seated in the full-stage position. In addition, in some embodiments the CPA device deflects the connector body toward the corresponding mating connector body, essentially "cinching" the connectors together to reduce the impact of vibration on the connector assembly. In some embodiments, additional features such as self-rejecting spring features may be utilized to provide additional, visual feedback that the CPA device is not fully seated in the full-stage position.

Figure 1A:
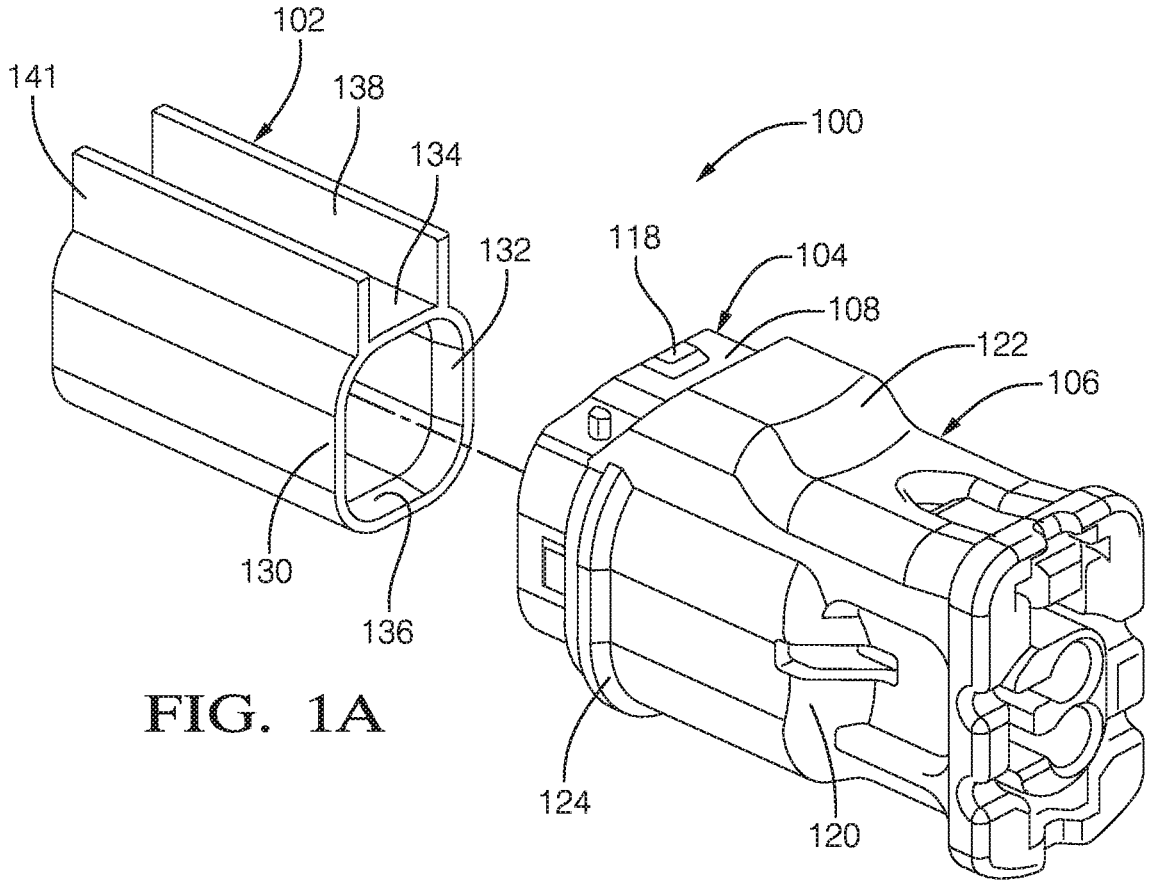
FIGS. 1A and 1B is a perspective view of a connector assembly 100 having a sliding connector position assurance (CPA) sleeve 106 according to some embodiments 1B is a perspective view of a connector body having a sliding CPA sleeve according to some embodiments.
Figure 1B:
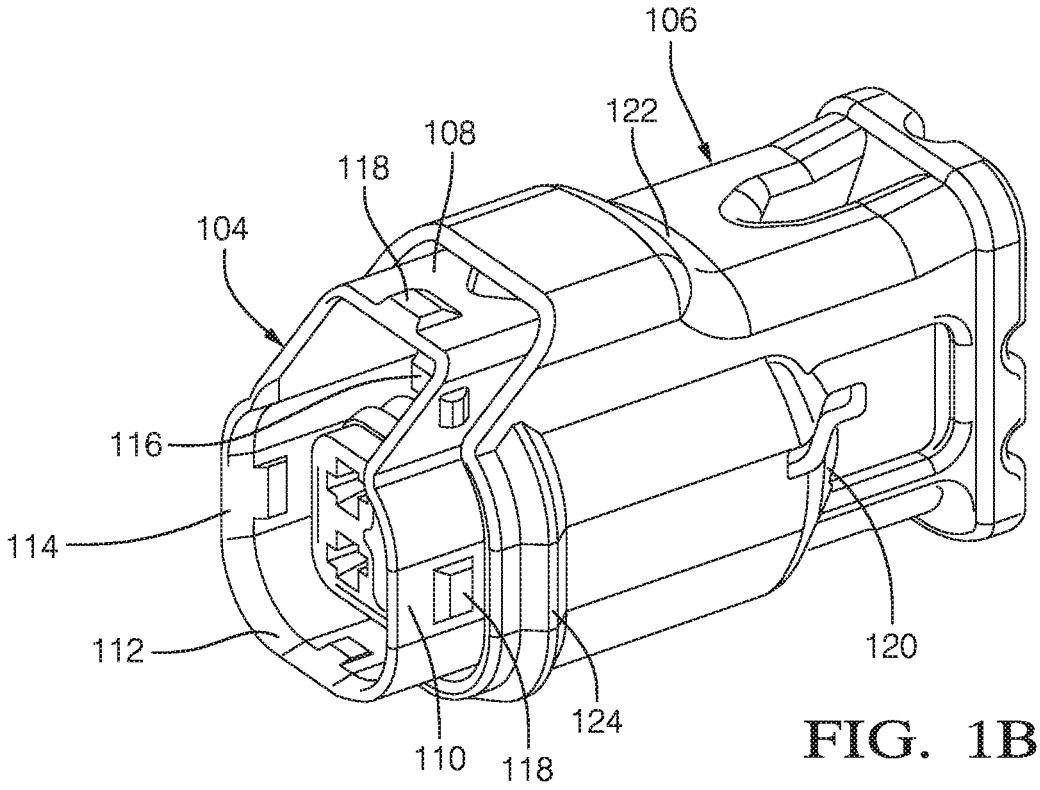

Referring now to FIGS. 1A and 1B, a connector assembly 100 is provided that includes a sliding connection position assurance (CPA) sleeve 106 according to some embodiments. Connector assembly 100 includes a connector body 104 and a corresponding mating connector body 102 configured to be removably connected with the connector body 104. In the embodiment shown in FIG. 1B, connector body 104 includes a plurality of walls—including top wall 108, side walls 110 and 114, and bottom wall 112 that defines a cavity for receiving the corresponding mating connector body 102. In some embodiments, one or more of the walls includes a deflectable latch (not shown) that is utilized to secure the connector body 104 to the corresponding mating connector body 102. Likewise, corresponding mating connector body 102 comprises a plurality of walls—including side walls 130, 132, top wall 134 and a bottom wall 136. In some embodiments, the corresponding mating connector body 102 further includes a pair of guide walls 138 and 141 extending vertically from the top wall 134. Corresponding mating connector body 102 is configured to fit within the cavity defined by the plurality of walls associated with connector body 104.

In addition, connector body 104 includes one or more deflectable latching members (e.g., deflectable latching member 116 located on the top wall 108) configured to interact with a corresponding feature (e.g., not shown in this embodiment) located on the corresponding mating connector body 102. The deflectable latching member 116 is deflected in response to engagement of the connector body 104 with the corresponding feature on the corresponding mating connector body 102. When fully engaged the deflectable latching member 116 captures the corresponding feature on the corresponding mating connector body 102, providing a mechanical connection between the connector body 104 and the corresponding mating connector body 102. For example, in some embodiments the deflectable latching member 116 is located on the top wall 108 of the connector body 104 and the corresponding feature is located on the top wall 134 of the corresponding mating connector body 102.

In some embodiments, at least one of the plurality of walls 108, 110, 112, and/or 114 includes an inertial detent feature that interacts with the sliding CPA sleeve 106. For example, in the embodiment shown in FIG. 1B each of the plurality of walls 108, 110, 112, and 114 includes an inertial detent feature. In the view shown in FIG. 1B, an inertial detent feature is associated with deflectable latching member 116. In addition, another inertial detent feature 118 is visible on side wall 110. The inertial detent features 118 includes a raised portion that extends or protrudes from the surface of the corresponding wall. In some embodiments, the inertial detent features include a ramp on the side facing the CPA sleeve 106 that interacts with corresponding inertial detent features located on an inner surface of the CPA sleeve 106 to allow movement between the respective inertial detent features.

CPA sleeve 106 is utilized to ensure that the connector body 104 is fully engaged and connected with the corresponding mating connector body 102. In some embodiments, CPA sleeve 106 is slidably positioned adjacent to the connector body 104 and is moveable in a longitudinal direction from a pre-stage position to a full-stage position. In general, the purpose of the CPA sleeve 106 is to provide both tactile, audio, and/or visual confirmation that the connector body 104 and corresponding mating connector body 102 are fully engaged. To that end, the CPA sleeve 106 can only be placed in the full-stage position when the connector bodies are fully engaged. In the event the connector bodies are not fully engaged, the CPA sleeve 106 will not be slidable to the full-stage position.

In some embodiments, the CPA sleeve 106 further includes one or more ergonomic grips 120, 122 utilized by an operator to slide the CPA sleeve 106 from the pre-stage position to the full-stage position. In some embodiments, an additional ergonomic rib 124 is located on an outer surface of the CPA sleeve 106 and can be utilized by an operator to push the CPA sleeve from the pre-stage position to the full-stage position (or vice versa). In some embodiments, the CPA sleeve 106 is positioned to surround the connector body 104. For example, the connector body 104 includes a plurality of walls 108, 110, 112, and 114, wherein CPA sleeve 106 surrounds the plurality of walls making up the connector body 104. In some embodiments, CPA sleeve 106 slides in a longitudinal direction between a pre-stage position and a full-stage position. FIG. 1B illustrates the CPA sleeve 106 in a pre-stage position. As discussed in more detail below, when in the pre-stage position the deflectable latching member 116 can be deflected via engagement with the corresponding feature located on the corresponding mating connector body 102. Slidably moving the CPA sleeve 106 from the pre-stage position to the full-stage position requires full engagement between the connector body 104 and the corresponding mating connector body 102. If not fully engaged with one another, the CPA sleeve 106 is prevented from moving longitudinally by the deflected latching member 116. When in the full-stage position the CPA sleeve 106 prevents the deflectable latching member 116 from being deflected, and therefore prevents the connector body 104 from being disconnected from the corresponding mating connector body 102.

In addition, the CPA sleeve 106 includes a plurality of corresponding inertial detent features that interact with the inertial detent features (e.g., inertial detent features 118) located on the outer surface of one or more of the plurality of walls during transition from the pre-stage position to the full-stage position. The interaction between the inertial detent features located on one or more of the plurality of walls with the corresponding inertial detent features located on the CPA sleeve 106 presents a resistance to the sliding of the CPA sleeve 106 that must be overcome by a threshold level of force from the operator/technician to cause the inertial detent features to slide past one another to the full-stage position. The resistance provided by the interaction of the inertial detents and corresponding release when they move past one another provides a tactile response (e.g., ergonomic "inertial release") that is detectable by the operator, confirming that the CPA sleeve 106 is fully seated in the full-stage position. In addition, when the CPA sleeve 106 is fully seated in the full-stage position, the CPA sleeve 106 causes the one or more walls of the connector body 104 to deflect inward toward the walls of the corresponding mating connector body 102. This deflection of the one or more walls of the connector body 104 towards the walls of the corresponding mating connector body 102 provides an additional force (e.g., a cinching force) that reduces vibration between the respective connectors.

In some embodiments, the CPA sleeve 106 is manufactured using additive manufacturing (i.e., 3D printing techniques) that allow the CPA sleeve 106 to be built surrounding the connector body 104. In some embodiments, the materials and/or size of the CPA sleeve 106 is selected to provide increased rigidity relative to the walls of the connector body 104. This ensures that force applied by the CPA sleeve 106 results in deflection of one or more walls of the connector body 104 towards the corresponding mating connector body 102 rather than resulting in a deflection of the CPA sleeve 106. In some embodiments, the CPA sleeve 106 completely surrounds the connector body 104. In other embodiments, the CPA sleeve 106 only partially surrounds the connector body 104.

Figure 2A:
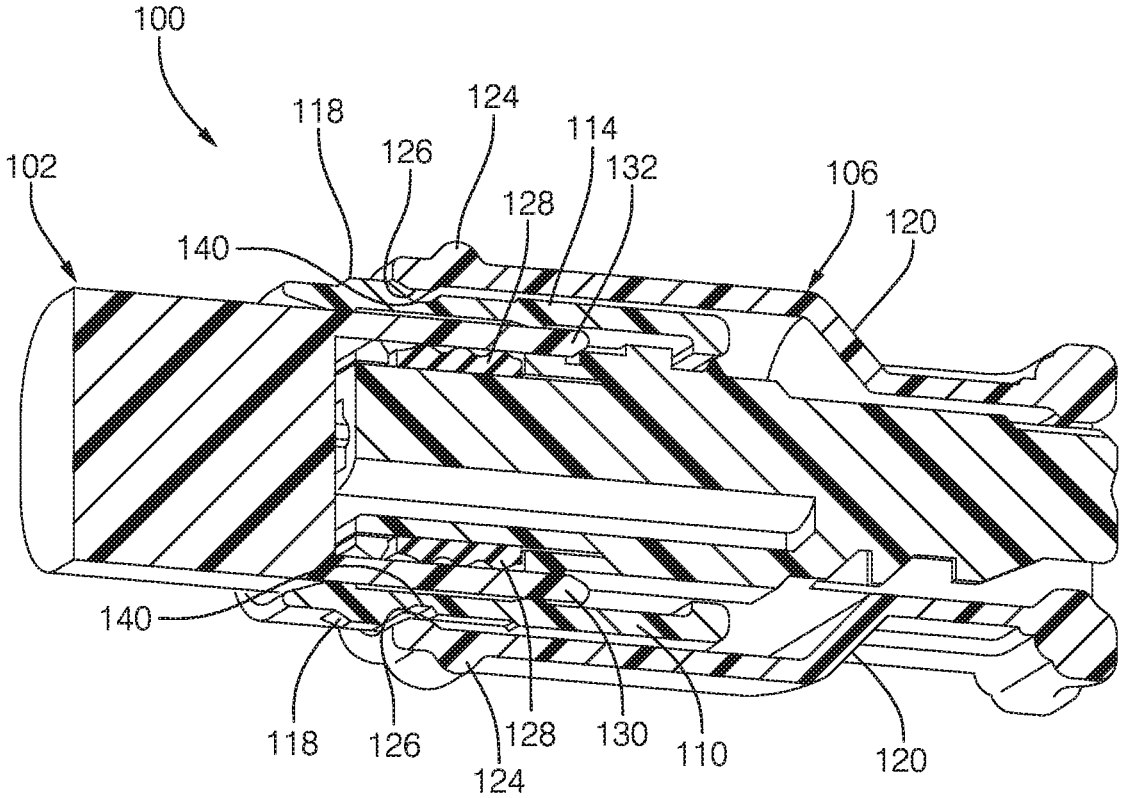
FIGS. 2A and 2B are cross-sectional views that illustrate the sliding CPA sleeve in an open position and a mated position, respectively, according to some embodiments.
Figure 2B:
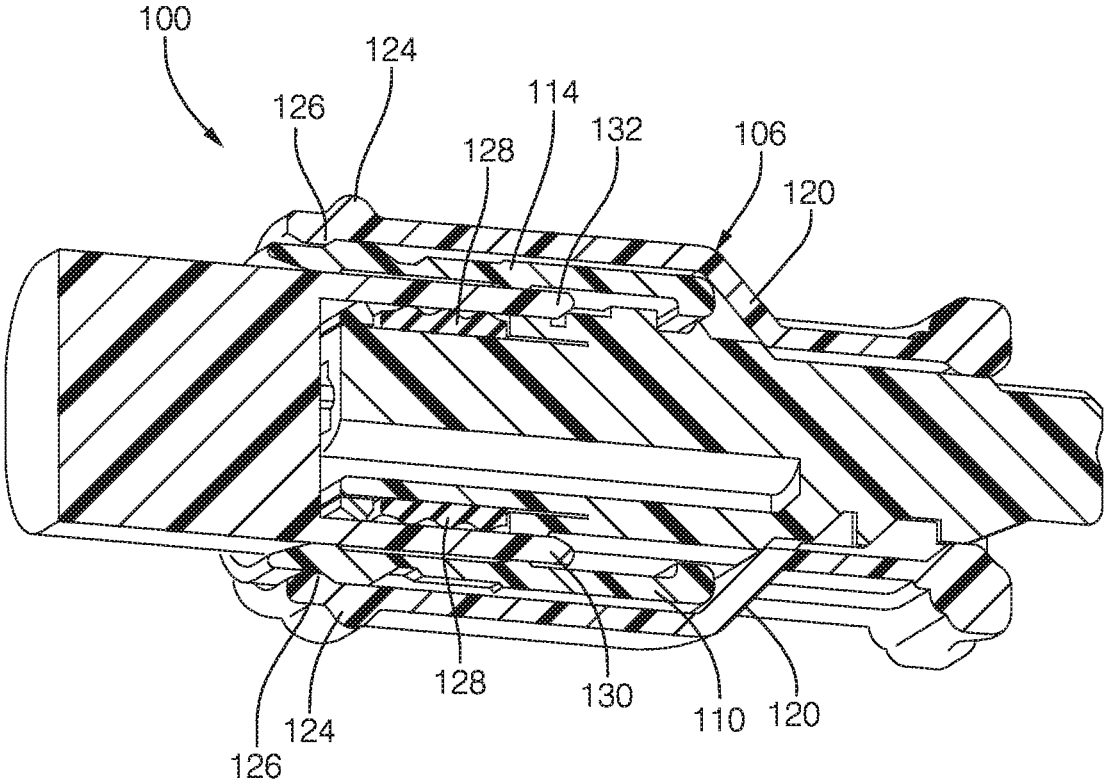

Referring now to FIGS. 2A and 2B, a cross-sectional view of the connector assembly 100 is taken along a horizontal plane. In the embodiment shown in FIGS. 2A and 2B, the corresponding mating connector body 102 includes side walls 130 and 132 located opposite one another. In this example, coupling of connector body 104 with the corresponding mating connector body 102 includes sliding the side walls 130 and 132 within the cavity defined—at least in part—by side walls 110 and 114 of the connector body 104. In some embodiments, one or more seals 128 located within the interior cavity of the connector body 104 engage the inner surface of side walls 130 and 132 to prevent liquid and/or debris from degrading the performance of the connector. Although not visible in either FIG. 2A or 2B, one or more deflectable latching members located on one or more of the plurality of walls associated with the connector body 104 would engage with one or more corresponding latching nib features (e.g., shark fin feature) associated with the corresponding mating connector body 102.

In the embodiment shown in FIG. 2A, the CPA sleeve 106 is in the pre-stage position. In some embodiments, the CPA sleeve 106 surrounds the connector body 104, and is configured to allow the CPA sleeve 106 to slide in a longitudinal direction. As discussed above, in some embodiments the connector body 104 includes one or more inertial detent features 118 protruding from an outer surface of one or more of the plurality of walls (e.g., side walls 110 and/or 114). Likewise, CPA sleeve 106 includes one or more corresponding inertial detent features 126 extending from an inner surface of the toward the connector body 104. In the pre-stage position, the inertial detent feature 118 does not interact with the corresponding inertial detent feature 126. For example, as shown in FIG. 2A, the inertial detent feature 118 is located adjacent to or outside of CPA sleeve 106.

In some embodiments, the connector body 104 may further include a recessed feature 140 that corresponds with the position of the inertial detent feature 126 in the pre-stage position. The alignment between the inertial detent feature 126 and the recessed feature 140 prevents the CPA sleeve 106 from deflecting or otherwise cinching the one or more walls associated with the connector body 104. This allows the corresponding mating connector body 102 to be coupled with the connector body 104.

Having secured the corresponding mating connector body 102 to the connector body 104, the CPA sleeve 106 may be slid longitudinally along the axis of the connector assembly from the pre-stage position (shown in FIG. 2A) to the full-stage position (shown in FIG. 2B). In some embodiments, the interaction between the inertial detent feature 118 associated with the outer surface of the connector body 104 and the corresponding inertial detent feature 126 associated with the interior surface of the CPA sleeve 106 provides an ergonomic resistance to the sliding of the CPA sleeve 106. That is, the operator sliding the CPA sleeve 106 will be required to exert a detectable level of force in engaging the respective detent features. In some embodiments, the inertial detent feature 118 includes a ramp that allows the corresponding inertial detent feature to slide over the inertial detent feature 118. As the inertial detent feature 118 interacts with the corresponding inertial detent feature 126, the force exerted by the CPA sleeve 106 causes the one or more walls associated with the connector body 104 to deflect inward. The deflection of the one or more walls results in the storing of spring energy.

As shown in FIG. 2B, the CPA sleeve 106 reaches the full-stage position when the corresponding inertial detent feature 126 is slid to the opposite side of the inertial detent feature 118. The inertial detent feature 126 associated with the CPA sleeve 106 remains engaged with the outer surface of the connector body 104. However, when the corresponding inertial detent feature 126 slides past the inertial detent feature 118, an "inertial release" is detectable by the operator. This "inertial release" provides tactile feedback to the operator indicating that the CPA sleeve 106 is in the full-stage position. In some embodiments, the corresponding inertial detent feature 126 remains in contact with the outer surface of the connector body 104. In some embodiments, contact between the inertial detent feature 126 and the outer surface of the connector body 104 in the full-stage position provides at least some deflection of the one or more walls associated with the connector body 104. As a result, the plurality of walls associated with the connector body 104 are deflected toward the corresponding mating connector body 102—in effect cinching the connector body 104 with the corresponding mating connector body 102. One of the benefits of cinching the connector body 104 with the corresponding mating connector body 102 is the limiting of vibration between the connector body 104 and the corresponding mating connector body 102 during operation.

In some embodiments, inertial detent features are located on each of the plurality of walls associated with the connector body 104 and correspondingly with the CPA sleeve 106 such that each of the plurality of walls are deflected inward to cinch the connector body 104 against the corresponding mating connector body 102. In other embodiments, however, inertial detent features are not required on each of the plurality of walls. For example, in some embodiments inertial detent features are located on only two of the plurality of walls. In some embodiments, it may be beneficial for the inertial detent features to be on opposing walls (and correspondingly on opposing sides of the CPA sleeve 106) to ensure deflection of one side is met by deflection of the opposite side. In other embodiments, CPA sleeve 106 may not be required to completely surround the connector body 104. For example, the CPA sleeve 106 may only partially surround the connector body, so long as the same functional interaction between the CPA sleeve 106 and the connector body 104 is achieved.

Figure 3A:
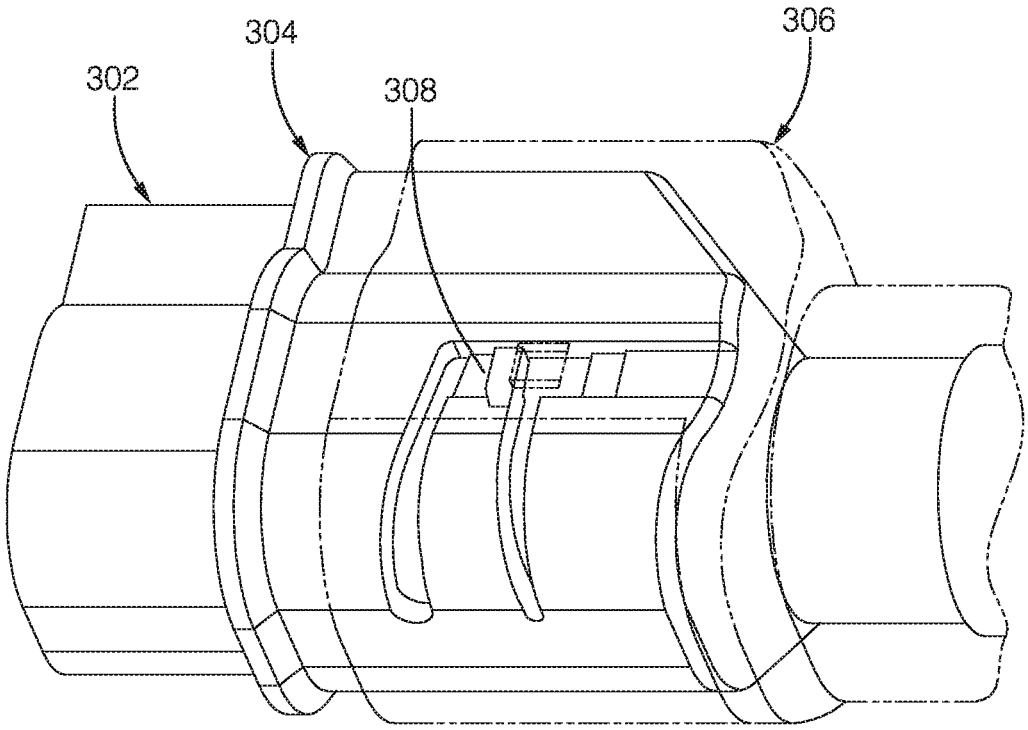
FIGS. 3A and 3B are perspective views of a connector body having a sliding CPA sleeve and a spring element configured to provide a spring back function if the connector assembly is not fully mated according to some embodiments.
Figure 3B:
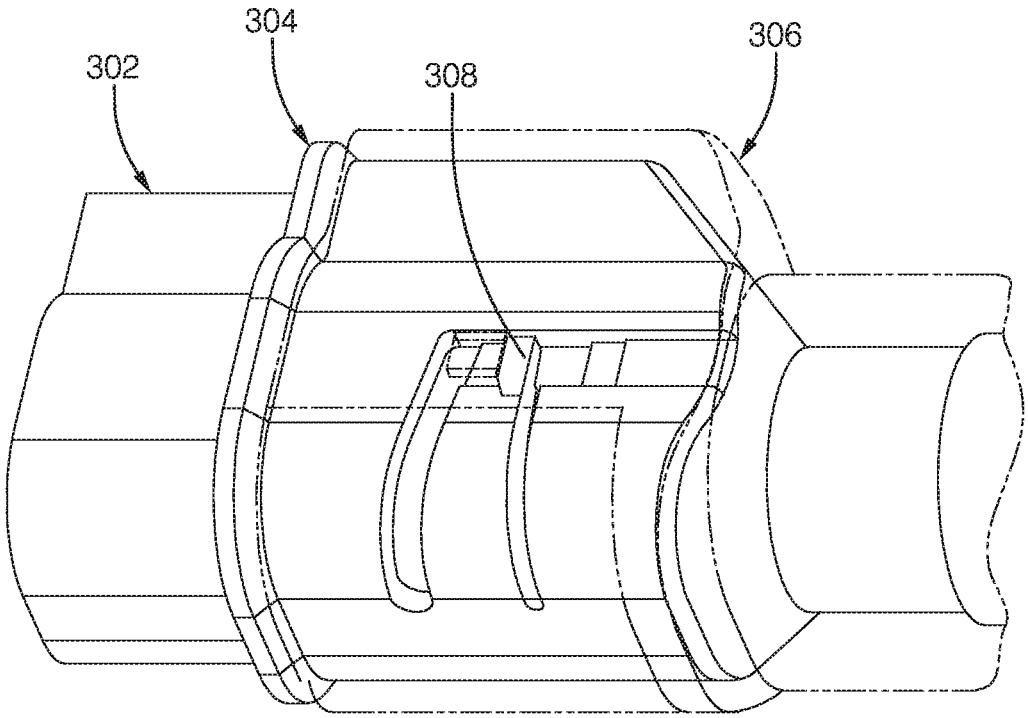

FIGS. 3A and 3B are perspective views of a connector assembly 300 according to some embodiments. Connector assembly 300 includes connector body 304, corresponding mating connector body 302, and CPA sleeve 306. As discussed above, CPA sleeve 306 is slidingly engaged with connector body 304, and slides longitudinally between a pre-stage position and a full-stage position. In the pre-stage position, corresponding mating connector body 302 is engaged with connector body 304. Once engaged, CPA sleeve 306 is slid in a longitudinal direction indicated by arrow 310 from the pre-stage position to a full-stage position. One or more inertial detent features (not shown in this view) located on an outer surface of the connector body 304 interact with one or more corresponding inertial detent features (also not shown in this view) to provide an ergonomic resistance to the sliding of the CPA sleeve 306. That is, the operator sliding the CPA sleeve 306 will be required to exert a detectable level of force in engaging the respective detent features. Interaction of the inertial detent features causes the plurality of walls associated with the connector body 304 to deflect inward, storing spring energy as a result. The full-stage position is reached when the inertial detent feature associated with the CPA sleeve 306 slides past the inertial detent feature associated with the connector body 304. At least some of the energy stored in the deflected walls of the connector body 304 is released, providing ergonomic "inertial release" tactile response that indicates to the operator that the CPA sleeve 306 is fully engaged (i.e., reached the full-stage position). In the full-stage position, the respective inertial detents prevent the CPA sleeve 306 from being disengaged (i.e., moved from the full-stage position to the pre-stage position). In addition, the inertial detent feature associated with the CPA sleeve 306 may remain in contact with the outer surface of the connector body 304, providing continued deflection of one or more of the plurality of walls associated with the connector body 304 toward the corresponding mating connector body 302. This provides a "cinching" of the connector body 304 with the corresponding mating connector body 302 that reduces motion between the respective bodies caused by vibration.

In the embodiment shown in FIGS. 3A and 3B, the connector body 304 further includes a spring element 308 that interacts with the CPA sleeve 306 during closing of the CPA sleeve 306 (i.e., movement of the CPA sleeve 306 from the pre-stage position to the full-stage position). In some embodiments, the spring element 308 acts to self-reject improper or partial closure of the CPA sleeve 306. As shown in FIG. 3A, as the CPA sleeve 306 is moved towards the full-stage position, the spring element 308 is deformed—thereby storing elastic energy. The spring element 308 snaps over or releases the stored energy (as shown in FIG. 3B) in response to the CPA sleeve 306 reaching the full-stage position. However, prior to reaching the full-stage position, if the CPA sleeve 306 is released by the operator, the energy stored in the spring element 308 rejects the CPA sleeve 306, causing the CPA sleeve to return to the pre-stage position. That is, the spring element 308 causes a spring-back back of the CPA sleeve 306 if the CPA sleeve 306 is not fully engaged in the full-stage position. Interaction between the CPA sleeve 306 and the spring element 308 located on the connector body 304 may utilize corresponding detent features (a first detent located on the spring element 308 and a second detent feature located on the inner surface of the CPA sleeve 306). The force applied by moving the CPA sleeve 306 to the full-stage position overcomes the spring force exerted by the spring element 308, allowing the CPA sleeve 306 to snap over the spring element 308 as shown in FIG. 3B. As shown in FIG. 3B, the spring element is no longer deflected, and therefore no longer stores any elastic energy.

A benefit of the embodiment shown in FIGS. 3A and 3B is that it CPA sleeve 306 is self-rejected, in that if the respective connector bodies are not fully engaged and the CPA sleeve 306 is not fully engaged in the full-stage position, the CPA sleeve is sprung back to the pre-stage position (or approximately to the pre-stage position). This provides visual feedback to the operator regarding the status of the CPA sleeve 306 (i.e., whether it is fully engaged or not).

Referring now to FIGS. 4A-4D, a connector assembly 400 having a self-rejecting CPA 406 is provided. The connector assembly 400 further includes a connector body 404 (e.g., female connector) and a corresponding mating connector body 402 (e.g., male connector) that interacts with the connector body 404. Connector body 404 is comprised of a plurality of walls that form a cavity for receiving the corresponding mating connector body 402 (shown in FIG. 4B). In some embodiments, the connector body 404 includes a deflectable latching member 410 (shown in FIGS. 4C and 4D) configured to interact with a corresponding latching nib feature 411 (e.g., shark fin, shown in FIGS. 4C and 4D) to engage/lock the connector body 404 to the corresponding mating connector body 402. For example, in the embodiment shown in FIGS. 4C and 4D, deflectable latching member 410 is secured on the opposite side of corresponding latching nib feature 411 to prevent the respective connector bodies from becoming detached.

Figure 4A:
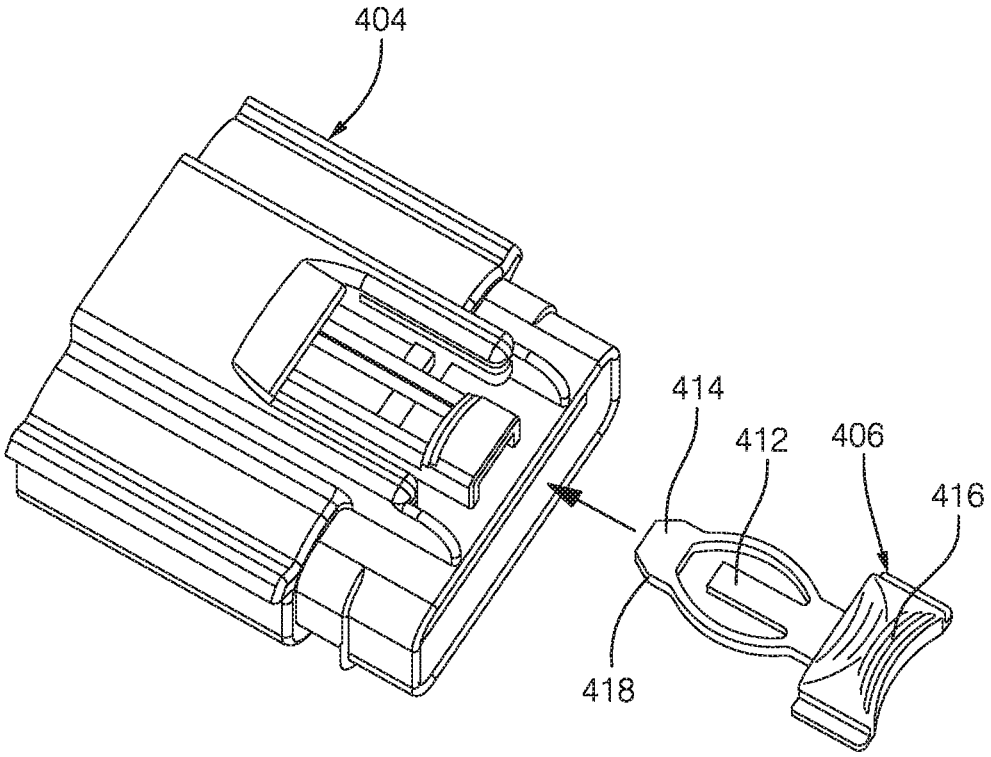
FIGS. 4A and 4B are perspective views of a connector assembly that includes a self-rejecting CPA spring according to some embodiments.
Figure 4B:
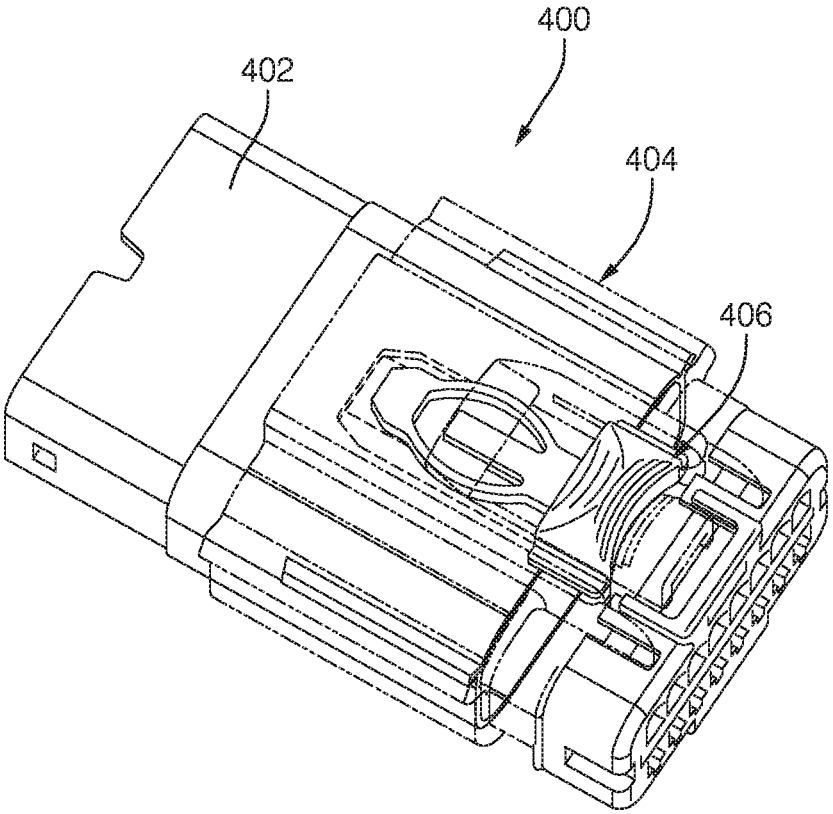

The self-rejecting CPA device 406 is utilized to ensure proper engagement between the connector body 104 and the corresponding mating connector body 102. The self-rejecting CPA 406 includes an inner arm 412 (sometimes referred to as an over stress protection feature), a hoop spring 414, and a tab 416 for use by an operator to push the self-rejecting CPA device 406 from a pre-stage position to a full-stage position. As shown in FIG. 4A, the inner arm 412 extends into the interior portion of the hoop spring 414, which surrounds the inner arm 412. The distal end of the hoop spring 414 includes a detent feature 418 that interacts with connector body 404 during engagement of the CPA device 406 from the pre-stage position to the full-stage position.

Figure 4C:
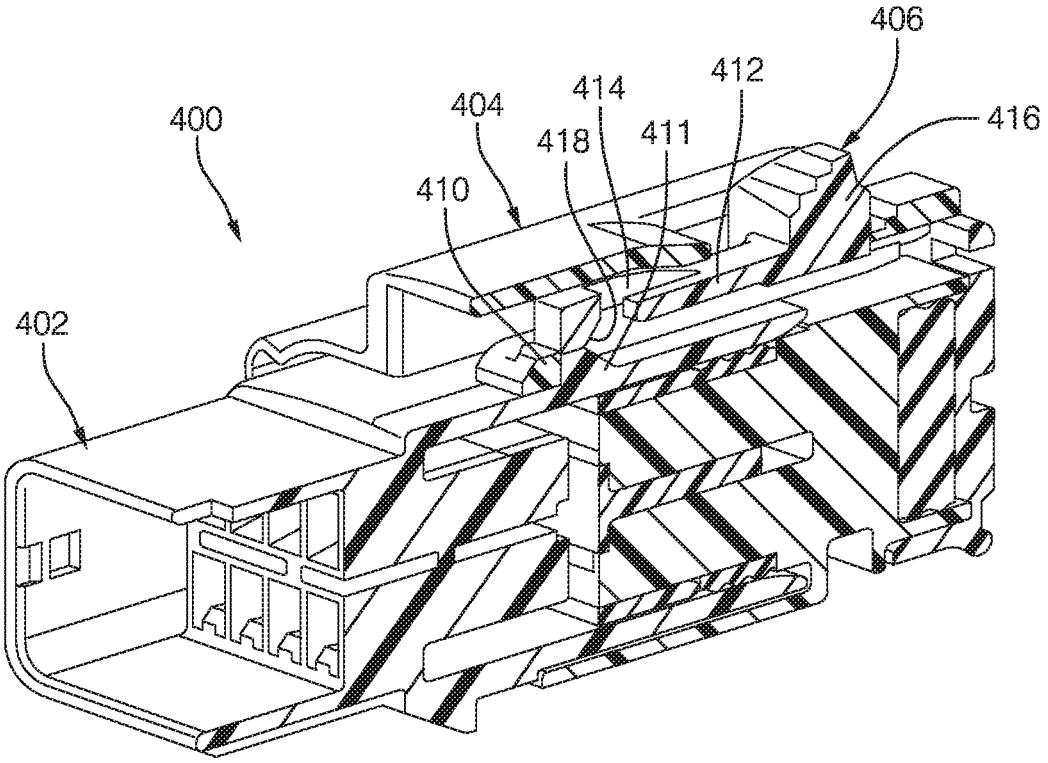
FIGS. 4C and 4D are cross-sectional views of a connector assembly that includes a self-rejecting CPA spring according to some embodiments.
Figure 4D:
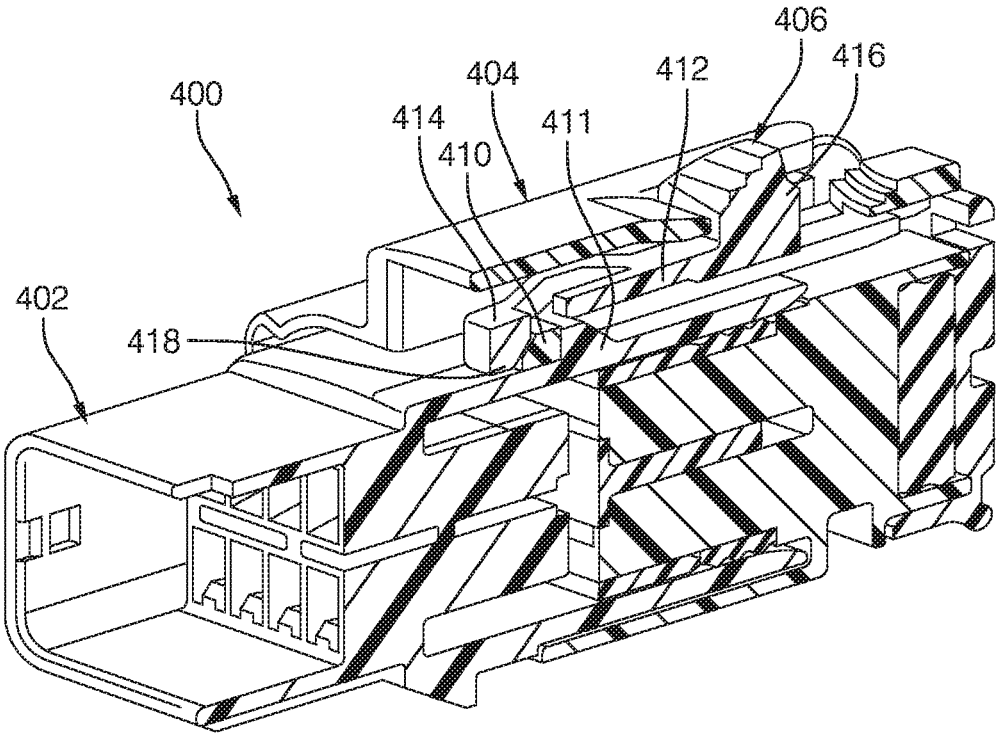

Referring now to the cross-sectional views shown in FIGS. 4C and 4D, the interaction between the CPA device 406 and the connector body 404 is illustrated in more detail. In the embodiment shown in FIG. 4C, connector body 404 is fully engaged with corresponding mating connector body 402. In particular, deflectable latching member 410 associated with connector body 404 is positioned on the opposite side of the corresponding latching nib feature 411 utilized to deflect and capture the deflectable latching member 410. In the event that the connector body 404 is not fully mated with the corresponding mating connector body 402, then the deflectable latching member 410 would remain in a deflected position that would interfere and prevent the CPA device 406 from moving to the full-stage position. However, when fully coupled the CPA device 406—and in particular the detent feature 418 located at the distal end of the hoop spring 414—is able to slide over the corresponding latching nib feature 411 as shown in FIG. 4D. Interaction between the detent feature 418 and the corresponding latching nib feature 411 causes the hoop spring 414 to deflect. When the detent feature 418 clears the latching nib feature 411 and deflectable latching member 410, the energy stored in the deflected hoop spring 414 causes it to snap over. In this way, the hoop spring 414 provides audible feedback to the operator assuring the operator that the CPA device 406 is in the full-stage position. In addition, elastic energy stored in the hoop spring as it is deflected provides self-rejecting functionality to the CPA device 406. For example, if an operator engages the CPA device 406 only partially from the pre-stage position to the full-stage position, the elastic energy stored in the hoop spring 414 causes the CPA device 406 to move back to the pre-stage position if released by the operator. Thus, the CPA device 406 also provides easy visual confirmation that the connectors are fully engaged, as the CPA device 406 will either be in the full-stage position or rejected and pushed to the pre-stage position.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

According to one aspect, a connector assembly is provided that includes a connector body, a corresponding mating connector body, and a connection position assurance (CPA) device. The connector body includes a deflectable latching member and at least one outer detent feature located on an outer surface of the connector body. The corresponding mating connector body is configured to be removably connected with the connector body, wherein the deflectable latching member is configured to secure the connector body to the corresponding mating connector body. The connection position assurance (CPA) device is slidably positioned adjacent the connector body and moveable from a pre-stage position to a full-stage position, wherein the CPA device interacts with the at least one outer detent feature located on the outer surface of the connector body to deflect the connector body towards the corresponding mating connector body.

The connector assembly of the preceding paragraph can optionally include, additionally and/or alternatively any, one or more of the following features, configurations, and/or additional components.

For example, in some embodiments the CPA device may include an inner detent feature located on an inner surface of the CPA device that interacts with the outer detent feature located on the outer surface of the connector body, wherein the inner detent feature interacts with the outer detent feature when moving from the pre-stage position to the full-stage position.

In some embodiments, the CPA device may be a sleeve that surrounds the connector body.

In some embodiments, the corresponding mating connector body may include a latching nib, wherein the deflectable latching member is deflected by engagement with the latching nib.

In some embodiments, the deflectable latching member and the latching nib may inhibit movement of the CPA device from the pre-stage position to the full-stage position until the connector body is fully mated with the corresponding mating connector body.

In some embodiments, the CPA device may prevent deflection of the deflectable latching member when in the full-stage position.

In some embodiments, the connector body may further includes at least one spring element that is deflected in response to the CPA device slidably moving from the pre-stage position to the full-stage position, wherein the spring element snaps over in response to the CPA device reaching the full-stage position.

In some embodiments, wherein the at least one spring element may store energy in response to the CPA device moving longitudinally from the pre-stage position to the full-stage position, wherein the energy stored in the spring element causes the CPA device to spring back if not in the full-stage position.

In some embodiments, the connector body may include a first plurality of walls and wherein outer detent features are located on one or more of the first plurality of walls.

In some embodiments, the corresponding mating connector body may include a second plurality of walls located inward of the first plurality of walls when the corresponding mating connector body is connected with the connector body, wherein movement of the CPA device from the pre-stage position to the full-stage position causes one or more of the first plurality of walls to deflect towards the second plurality of walls.

According to another aspect, a method for operating a connector assembly includes mating a connector body with a corresponding mating connector body, wherein the connector body includes a deflectable latching member configured to interact with a latching nib located on the corresponding mating connector body. The method further includes moving a connector position assurance (CPA) device from a pre-stage position that allows the latching member to deflect to a full-stage position that prevents the latching member from deflecting, wherein the CPA device interacts with an outer detent feature located on the outer surface of the connector body to deflect the connector body towards the corresponding mating connector body in the full-stage position.

The method of the preceding paragraph can optionally include, additionally and/or alternatively any, one or more of the following features, configurations and/or additional components.

For example, in some embodiments the method may further include providing tactile feedback to an operator based on interaction of the CPA device with the outer detent feature of the connector body, wherein the tactile feedback indicates whether the CPA device is in the full-stage position.

In some embodiments, the method may further include providing visual feedback to an operator based on a position of the CPA device.

In some embodiments, the CPA device may be a sleeve that surrounds the connector body.

In some embodiments, the connector body may be a female connector and the corresponding mating connector body may be a male connector.

In some embodiments, a self-rejecting feature located on the connector body may interact with the CPA device to cause the CPA device to spring back to the pre-stage position if not moved fully to the full-stage position.

In some embodiments, the self-rejecting feature may be a spring located on an outer surface of the connector body, wherein the spring stores energy when moving the CPA device from the pre-stage position to the full-stage position, wherein the springs snaps over when the CPA device is fully moved to the full-stage position.

According to another aspect, a connector assembly includes a connector body, a corresponding mating connector body, and a connection position assurance (CPA) device. The connector body includes a deflectable latching member and at least one outer detent feature located on an outer surface of the connector body. The corresponding mating connector body is configured to be removably connected with the connector body, wherein the deflectable latching member is configured to secure the connector body to the corresponding mating connector body. The connection position assurance (CPA) device includes a spring over stress protection feature and a hoop spring surrounding the spring over stress protection feature, wherein the hoop spring is deflected by the latching member as the CPA device is moved from a pre-stage position to a full-stage position. The hoop spring snaps over the deflectable latching member when in the full-stage position and the spring over stress protection feature interacts with the deflectable latching member to prevent deflecting of the latching member.

The connector assembly of the preceding paragraph can optionally include, additionally and/or alternatively any, one or more of the following features, configurations, and/or additional components.

For example, in some embodiments the hoop spring may provide an audible feedback in response to the CPA device reaching the full-stage position.

In some embodiments, the CPA device may provide visual feedback in response to the CPA device reaching the full-stage position.

The invention claimed is:

1. A connector assembly, comprising:

a connector body having a deflectable latching member and at least one outer detent feature located on an outer surface of the connector body;

a corresponding mating connector body configured to be removably connected with the connector body, wherein the deflectable latching member is configured to secure the connector body to the corresponding mating connector body; and a connection position assurance (CPA) device slidably positioned adjacent the connector body and moveable from a pre-stage position to a full-stage position, wherein the CPA device interacts with the at least one outer detent feature located on the outer surface of the connector body to deflect the connector body towards the corresponding mating connector body;

wherein the connector body includes a first plurality of walls and wherein outer detent features are located on one or more of the first plurality of walls; and wherein the corresponding mating connector body includes a second plurality of walls located inward of the first plurality of walls when the corresponding mating connector body is connected with the connector body, wherein movement of the CPA device from the pre-stage position to the full-stage position causes one or more of the first plurality of walls to deflect towards the second plurality of walls.

2. The connector assembly of claim 1, wherein the CPA device includes an inner detent feature located on an inner surface of the CPA device that interacts with the outer detent feature located on the outer surface of the connector body, wherein the inner detent feature interacts with the outer detent feature when moving from the pre-stage position to the full-stage position.

3. The connector assembly of claim 1, wherein the CPA device is a sleeve that surrounds the connector body.

4. The connector assembly of claim 1, wherein the corresponding mating connector body includes a latching nib, wherein the deflectable latching member is deflected by engagement with the latching nib.

5. The connector assembly of claim 4, wherein the deflectable latching member and the latching nib inhibit movement of the CPA device from the pre-stage position to the full-stage position until the connector body is fully mated with the corresponding mating connector body.

6. The connector assembly of claim 5, wherein the CPA device prevents deflection of the deflectable latching member when in the full-stage position.

7. The connector assembly of claim 1, wherein the connector body further includes at least one spring element that is deflected in response to the CPA device slidably moving from the pre-stage position to the full-stage position, wherein the spring element snaps over in response to the CPA device reaching the full-stage position.

8. The connector assembly of claim 7, wherein the at least one spring element stores energy in response to the CPA device moving longitudinally from the pre-stage position to the full-stage position, wherein the energy stored in the spring element causes the CPA device to spring back if not in the full-stage position.

9. A method for operating a connector assembly, the method comprising:

mating a connector body with a corresponding mating connector body, wherein the connector body includes a deflectable latching member configured to interact with a latching nib located on the corresponding mating connector body;

moving a connector position assurance (CPA) device from a pre-stage position that allows the latching member to deflect to a full-stage position that prevents the latching member from deflecting, wherein the CPA device interacts with an outer detent feature located on the outer surface of the connector body to deflect the connector body towards the corresponding mating connector body in the full-stage position; and providing tactile feedback to an operator based on interaction of the CPA device with the outer detent feature of the connector body, wherein the tactile feedback indicates whether the CPA device is in the full-stage position.

10. The method of claim 9, further including:

providing visual feedback to an operator based on a position of the CPA device.

11. The method of claim 9, wherein the CPA device is a sleeve that surrounds the connector body.

12. The method of claim 11, wherein the connector body is a female connector and the corresponding mating connector body is a male connector.

13. The method of claim 9, wherein a self-rejecting feature located on the connector body interacts with the CPA device to cause the CPA device to spring back to the pre-stage position if not moved fully to the full-stage position.

14. The method of claim 13, wherein the self-rejecting feature is a spring located on an outer surface of the connector body, wherein the spring stores energy when moving the CPA device from the pre-stage position to the full-stage position, wherein the springs snaps over when the CPA device is fully moved to the full-stage position.

15. A connector assembly, comprising:

a connector body having a deflectable latching member and at least one outer detent feature located on an outer surface of the connector body;

a corresponding mating connector body configured to be removably connected with the connector body, wherein the deflectable latching member is configured to secure the connector body to the corresponding mating connector body; and a connection position assurance (CPA) device having a spring over stress protection feature and a hoop spring surrounding the spring over stress protection feature, wherein the hoop spring is deflected by the latching member as the CPA device is moved from a pre-stage position to a full-stage position, wherein the hoop spring snaps over the deflectable latching member when in the full-stage position and the spring over stress protection feature interacts with the deflectable latching member to prevent deflecting of the latching member.

16. The connector assembly of claim 15, wherein the hoop spring provides an audible feedback in response to the CPA device reaching the full-stage position.

17. The connector assembly of claim 15, wherein the CPA device provides a visual feedback in response to the CPA device reaching the full-stage position.

* * * * *